US009007269B2

(12) United States Patent
Lee et al.

(10) Patent No.: US 9,007,269 B2
(45) Date of Patent: Apr. 14, 2015

(54) DIELECTRIC WAVEGUIDE ANTENNA

(71) Applicants: Samsung Electro-Mechanics Co., Ltd., Suwon-si (KR); Korea University Research and Business Foundation, Seoul (KR)

(72) Inventors: Jung Aun Lee, Suwon-si (KR); Myeong Woo Han, Yongin-si (KR); Chul Gyun Park, Suwon-si (KR); Moonil Kim, Seongnam-si (KR); Seung Ho Choi, Seoul (KR); Kook Joo Lee, Seoul (KR)

(73) Assignees: Samsung Electro-Mechanics Co., Ltd., Suwon-si (KR); Korea University Research and Business Foundation, Seoul (KR)

( * ) Notice: Subject to any disclaimer, the term of this patent is extended or adjusted under 35 U.S.C. 154(b) by 0 days.

(21) Appl. No.: 14/185,305

(22) Filed: Feb. 20, 2014

(65) Prior Publication Data

US 2014/0168024 A1 Jun. 19, 2014

Related U.S. Application Data

(63) Continuation of application No. 13/092,091, filed on Apr. 21, 2011, now Pat. No. 8,692,731.

(30) Foreign Application Priority Data

Feb. 16, 2011 (KR) ..... 10-2011-0013793

(51) Int. Cl.

| | |
|---|---|
| ***H01Q 13/00*** | (2006.01) |
| ***H01Q 13/10*** | (2006.01) |
| ***H01Q 13/06*** | (2006.01) |
| ***H01P 3/12*** | (2006.01) |
| ***H01P 5/02*** | (2006.01) |

(52) U.S. Cl.

CPC ..... *H01Q 13/10* (2013.01); *H01Q 13/06* (2013.01); *H01P 3/121* (2013.01); *H01P 5/024* (2013.01)

(58) Field of Classification Search

USPC ..... 343/772, 785

See application file for complete search history.

(56) References Cited

U.S. PATENT DOCUMENTS

| | | | | |
|---|---|---|---|---|
| 6,366,244 | B1 | 4/2002 | Fernandes | |
| 8,692,731 | B2 * | 4/2014 | Lee et al. | 343/785 |

* cited by examiner

*Primary Examiner* — Kristy A Haupt

(74) *Attorney, Agent, or Firm* — NSIP Law

(57) ABSTRACT

Embodiments of the invention provide a dielectric waveguide antenna including a dielectric waveguide transmitting a signal applied from a power feeder, a dielectric waveguide radiator radiating the signal transmitted from the dielectric waveguide to the air through a first aperture, and a matching unit formed in a portion of the dielectric waveguide and controlling a serial reactance and a parallel reactance to thereby perform impedance matching between the dielectric waveguide radiator and the air, in order to reduce reflection generated in the first aperture during the radiation of the signal through the first aperture. Reflection in the aperture is reduced through the matching unit having various structures, thereby making it possible to improve characteristics of the dielectric waveguide antenna.

13 Claims, 6 Drawing Sheets

DIELECTRIC WAVEGUIDE ANTENNA

RELATED APPLICATION

This application is a continuation application of U.S. patent application Ser. No. 13/092,091, filed on Apr. 21, 2011, entitled, "Dielectric Waveguide Antenna," and claims the benefit of and priority to Korean Patent Application No. KR 10-2011-0013793, filed on Feb. 16, 2011, entitled "Dielectric Waveguide Antenna," all of which are incorporated herein by reference in their entirety into this application.

BACKGROUND

1. Field of the Invention

The present invention relates to a dielectric waveguide antenna.

2. Description of the Related Art

Recently, research into a transmission and reception system using a high frequency of a millimeter wave band has been actively conducted.

Particularly, the huge demand for a short-range wireless communication system using a broadband frequency of a 60 GHz band and a car radar system using a frequency of a 77 GHz band is expected.

In the transmission and reception system using a frequency of the millimeter wave band, the demand for development of a product in a system-on-package form has been increased in order to reduce loss generated during coupling of components, reduce a production cost through a single process, and miniaturize a product.

Generally, a size of an antenna is in inverse proportion to an operation frequency thereof, and a length thereof may be miniaturized to several millimeters in a millimeter wave band of 30 GHz or more.

Due to the miniaturization of an antenna size and the development of a multi-layer structure process such as a low temperature co-fired ceramic (LTCC) process, liquid crystal polymer (LCP) process, and the like, the transmission and reception system using the frequency of the millimeter wave band may be produced as the product in the system-on-package form.

A patch antenna having a planar structure has been mainly used in a stacking substrate environment such as the LTCC process and the LCT process. However, in the patch antenna, a horn antenna having a metal rectangular waveguide shape has been mainly used.

The horn antenna has high efficiency and broadband characteristics; however, it requires three-dimensional processing of a metal, has a large volume, and also has defects in a micro-snip or a strip line pit used in a general multi-layer substrate structure.

In order to solve these problems, an aperture antenna having a stacking structure and formed by implementing a rectangular waveguide in an inner portion of a stacking substrate using a via hole and modifying the horn antenna has been developed. However, in the aperture antenna of a stacking substrate environment, a problem in radiation characteristics may be generated.

Meanwhile, when a dielectric material is filled in an inner portion of the waveguide, a reflection coefficient between air and a waveguide antenna is increased, such that the radiation characteristics of the antenna are deteriorated.

The reason is that while radiation resistance on an aperture surface is not largely changed, a system impedance of the waveguide antenna is decreased due to increase in an electric constant.

Generally, the dielectric material used in a dielectric waveguide antenna has a dielectric constant of 6. However, a case of using a dielectric material having a high dielectric constant of 7 to 9 in order to reduce a size of the entire system and increase a Q value in a product such as a filter, etc., has been increased. In this case, a mismatch in the radiation resistance on the aperture surface is further increased.

As such, when the dielectric waveguide antenna according to the prior art is directly applied to the stacking substrate environment, reflection in an aperture of the dielectric waveguide antenna is increased due to the mismatch in the reflection resistance between the air and the dielectric waveguide antenna, such that antenna characteristics are deteriorated.

SUMMARY

Accordingly, embodiments of the present invention have been made in an effort to provide a dielectric waveguide antenna in which a matching unit having various structures for matching impedances between the dielectric waveguide antenna and air is formed in order to reduce reflection in an aperture of the dielectric waveguide antenna.

According to a first preferred embodiment of the present invention, there is provided a dielectric waveguide antenna including: a dielectric waveguide transmitting a signal applied from a power feeder; a dielectric waveguide radiator radiating the signal transmitted from the dielectric waveguide to the air through a first aperture; and a matching unit formed in a portion of the dielectric waveguide and controlling a serial reactance and a parallel reactance to thereby perform impedance matching between the dielectric waveguide radiator and the air, in order to reduce reflection generated in the first aperture during the radiation of the signal through the first aperture.

In accordance with an embodiment of the invention, the dielectric waveguide includes: a first conductor plate; a second conductor plate formed to be spaced from the first conductor plate and correspond thereto; a first dielectric substrate formed between the first and second conductor plates; and a plurality of first metal via holes having a first opening surface opened so as to connect the dielectric waveguide to the dielectric waveguide radiator in order to transmit the signal applied from the power feeder and vertically penetrating through circumferences of the first and second conductor plates to thereby form a metal interface on a side of the first dielectric substrate.

In accordance with an embodiment of the invention, the dielectric waveguide radiator includes: a third conductor plate having a first aperture formed therein; a fourth conductor plate formed to be spaced from the third conductor plate and correspond thereto; the first dielectric substrate formed between the third and fourth conductor plates; and a plurality Of second metal via holes having a first opening surface opened so as to connect the dielectric waveguide radiator to the dielectric waveguide in order to receive the signal transmitted from the dielectric waveguide and vertically penetrating through circumferences of the third and fourth conductor plates to thereby form a metal interface on a side of the first dielectric substrate.

In accordance with an embodiment of the invention, the matching unit has any one of a horizontal structure in which a dielectric volume is increased or decreased in a horizontal direction based on the dielectric waveguide according to a change in a width of a portion of the dielectric waveguide in order to control the serial reactance, a vertical structure in which the dielectric volume is increased or decreased in a vertical direction based on the dielectric waveguide according to a change in a height of a portion of the dielectric waveguide in order to control the parallel reactance, and a horizontal-vertical combination structure in Which the horizontal structure and the vertical structure coexist.

In accordance with an embodiment of the invention, the matching unit having the horizontal structure is a matching unit having a left horizontal structure including: a fifth conductor plate formed in a left horizontal direction based on the dielectric waveguide; a sixth conductor plate formed to be spaced from the fifth conductor plate and correspond thereto; the first dielectric substrate formed between the fifth and sixth conductor plates; and a plurality of third metal via holes having a second opening surface connected to the dielectric waveguide to thereby he opened and vertically penetrating through circumferences of the fifth and sixth conductor plates to thereby form a metal interface on a side of the first dielectric substrate.

In accordance with an embodiment of the invention, in the dielectric waveguide, the plurality of first metal via holes is not formed at the second opening surface.

In accordance with an embodiment of the invention, the matching unit having the horizontal structure is a matching unit having a right horizontal structure including: a seventh conductor plate formed in a right horizontal direction based on the dielectric waveguide; an eighth conductor plate formed to be spaced from the seventh conductor plate and correspond thereto; the first dielectric substrate formed between the seventh and eighth conductor plates; and a plurality of fourth metal via holes having a third, opening surface connected to the dielectric waveguide to thereby be opened and vertically penetrating through circumferences of the seventh and eighth conductor plates to thereby form a metal interface on a side of the first dielectric substrate.

In accordance with an embodiment of the invention, in the dielectric waveguide, the plurality of first metal via holes is not formed at the third opening surface.

In accordance with an embodiment of the invention, the matching unit having the vertical structure is a matching unit having an upward vertical structure including: a ninth conductor plate formed in an upward vertical direction based on the dielectric waveguide; the first dielectric substrate formed between the first and ninth conductor plates; and a plurality of fifth metal via holes having a fourth opening surface connected to the dielectric waveguide to thereby be opened and vertically penetrating through a circumference of the ninth conductor plate to thereby form. a metal interface on a side of the first dielectric substrate.

In accordance with an embodiment of the invention, in the dielectric waveguide, the first conductor plate is not formed at the fourth opening surface.

In accordance with an embodiment of the invention, the matching unit having the vertical structure is a matching unit having a downward vertical structure including; a tenth conductor plate formed in a downward vertical direction based on the dielectric waveguide; the first dielectric substrate formed between the second and tenth conductor plates; and a plurality of sixth metal via holes having a fifth opening surface connected to the dielectric waveguide to thereby be opened and vertically penetrating through a circumference of the tenth conductor plate to thereby form a metal interface on a side of the first dielectric substrate.

In accordance with an embodiment of the invention, in the dielectric waveguide, the second conductor plate is not formed at the fifth opening surface.

In accordance with an embodiment of the invention, the matching unit is formed to have a symmetrical shape based on the dielectric waveguide.

In accordance with an embodiment of the invention, the matching unit is formed to have an asymmetrical shape based on the dielectric waveguide.

In accordance with an embodiment of the invention, the matching unit has a polyprism shape.

In accordance with an embodiment of the invention, the matching unit has a step shape.

According to a second preferred embodiment of the present invention, there is provided a dielectric waveguide antenna including: a dielectric waveguide transmitting a signal applied from a power feeder; a dielectric waveguide radiator radiating the signal transmitted from the dielectric waveguide to the air through a first aperture; and a matching unit formed on the first aperture to thereby perform impedance matching between the dielectric waveguide radiator and the air, in order to reduce reflection generated in the first aperture during the radiation of the signal through the first aperture.

In accordance with an embodiment of the invention, the dielectric waveguide includes: a first conductor plate; a second conductor plate formed to be spaced from the first conductor plate and correspond thereto; a first dielectric substrate formed between the first and second conductor plates; and a plurality of first metal via holes having a first opening surface Opened so as to connect the dielectric waveguide to the dielectric waveguide radiator in order to transmit the signal applied from the power feeder and vertically penetrating through circumferences of the first and second conductor plates to thereby form a metal interface on a side of the first dielectric substrate.

In accordance with an embodiment of the invention, the dielectric waveguide radiator includes: a third conductor plate having a first aperture formed therein; a fourth conductor plate formed to be spaced from the third conductor plate and correspond thereto; the first dielectric substrate formed between the third and fourth conductor plates; and a plurality of second metal via holes having a first opening surface opened so as to connect the dielectric waveguide radiator to the dielectric waveguide in order to receive the signal transmitted from the dielectric waveguide and vertically penetrating through circumferences of the third and fourth conductor plates to thereby form a metal interface on the side of the first dielectric substrate.

In accordance with an embodiment of the invention, the matching unit includes a second dielectric substrate stacked on the aperture of the dielectric waveguide radiator.

In accordance with an embodiment of the invention, the matching unit performs impedance matching by controlling a thickness of the second dielectric substrate.

In accordance with an embodiment of the invention, the matching unit performs impedance matching by controlling a dielectric constant of the second dielectric substrate.

In accordance with an embodiment of the invention, a kind of the second dielectric substrate is the same as that of the first dielectric substrate.

In accordance with an embodiment of the invention, the second dielectric substrate is formed of a single dielectric layer.

In accordance with an embodiment of the invention, the second dielectric substrate is formed of a plurality of dielectric layers.

In accordance with an embodiment of the invention, the second dielectric substrate is a dielectric substrate stacked so that the plurality of dielectric layers thereof have a gradually increasing or decreasing dielectric constant from the dielectric waveguide radiator toward the air according to a dielectric constant of the first dielectric substrate and a dielectric constant of the air.

In accordance with an embodiment of the invention, the matching unit includes: an eleventh conductor plate having a second aperture corresponding to the first aperture; a second dielectric substrate formed between the eleventh conductor plate and the dielectric waveguide radiator; and a plurality of seventh metal via holes corresponding to the plurality of second metal via holes and vertically penetrating through a circumference of the second aperture to thereby form a metal interface on a side of the second dielectric substrate.

In accordance with an embodiment of the invention, the kind of the second dielectric substrate is different from that of the first dielectric substrate.

In accordance with an embodiment of the invention, the second dielectric substrate is formed of a single dielectric layer.

In accordance with an embodiment of the invention, the second dielectric substrate is formed of a plurality of dielectric layers.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not he construed as limited to the illustrated embodiments set forth herein. Rather, these embodiments are provided so that this disclosure will be thorough and complete, and will fully convey the scope of the invention to those skilled in the art, Like numbers refer to like elements throughout. Prime notation, if used, indicates similar elements in alternative embodiments.

Figure 1A:
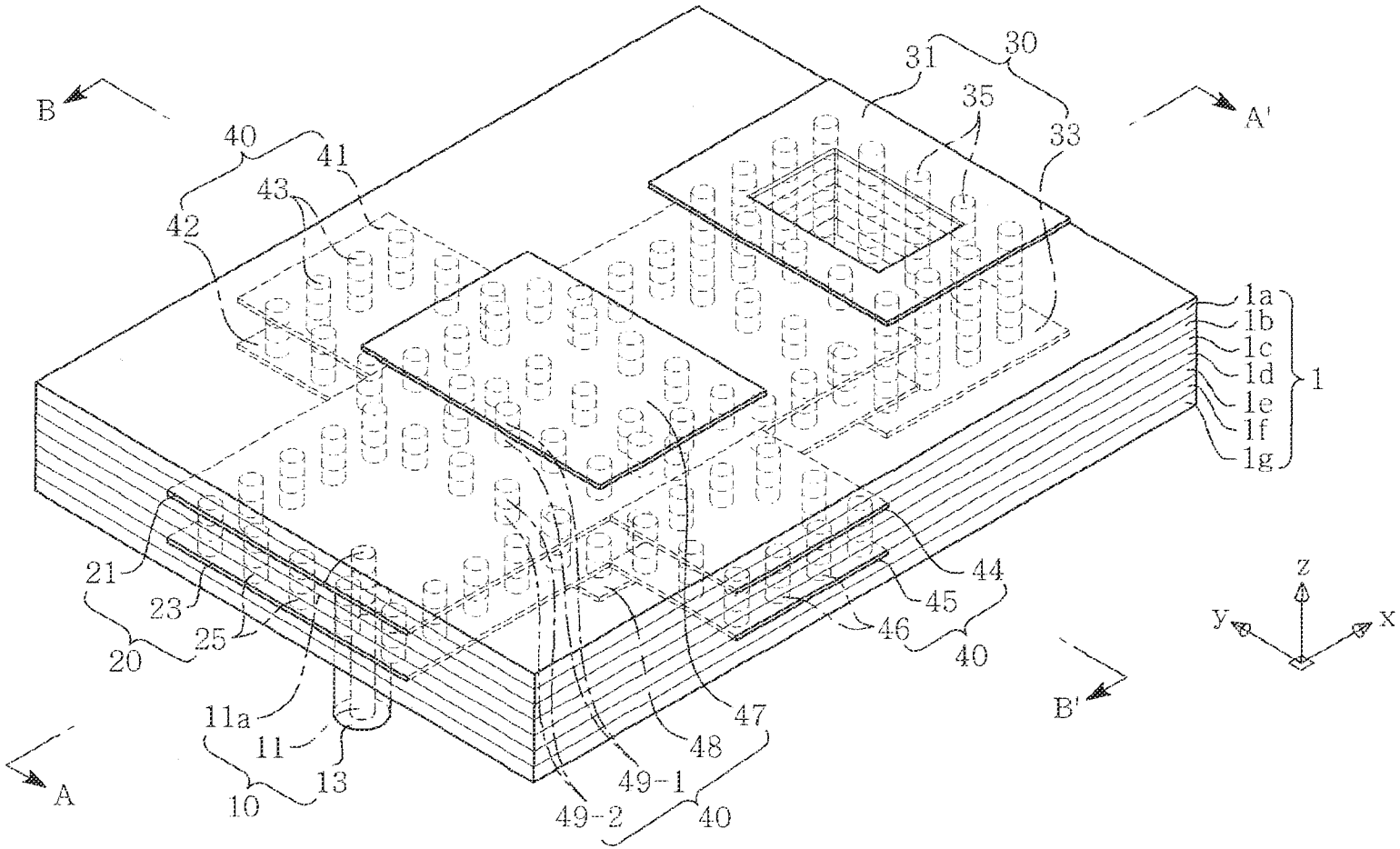
FIG. 1A is a perspective view of a dielectric waveguide antenna according to a first preferred embodiment of the present invention.
Figure 1B:
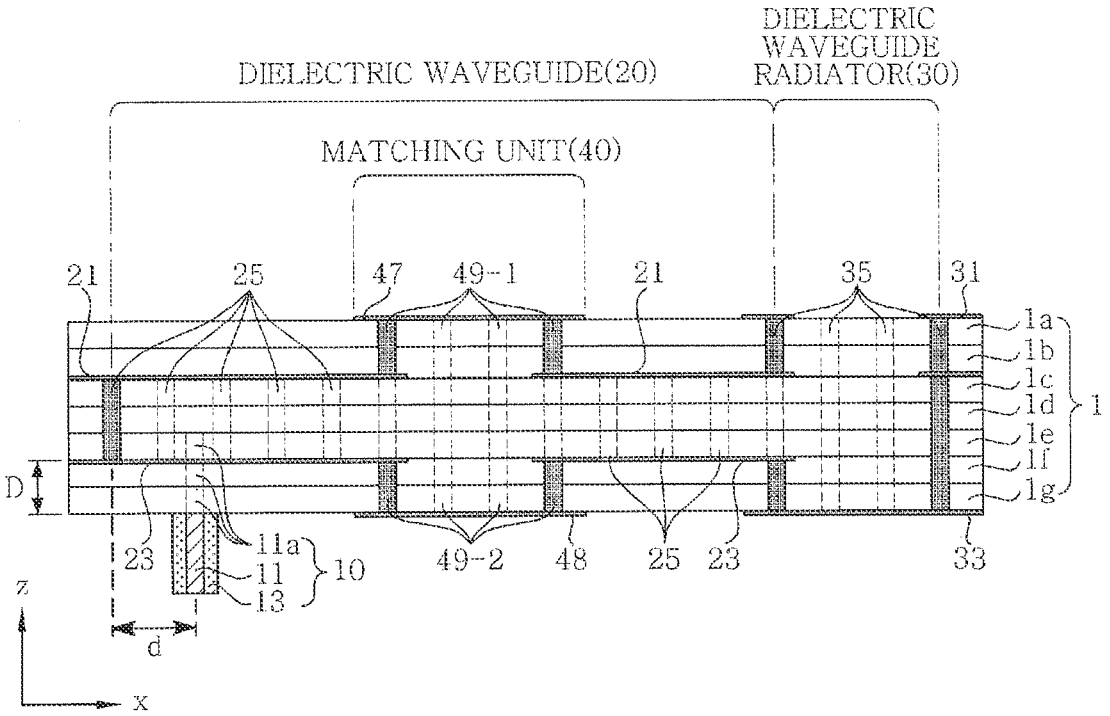
FIG. 1B is a cross-sectional view taken along the line A-A' in the dielectric waveguide antenna shown in FIG. 1A.
Figure 1C:
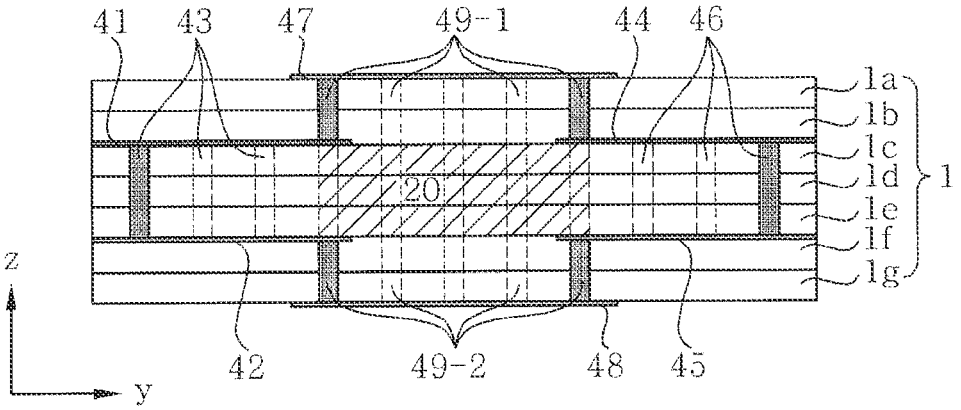
FIG. 1C is a cross-sectional view taken along the line B-B' in the dielectric waveguide antenna shown in FIG. 1A.
Figure 1D:
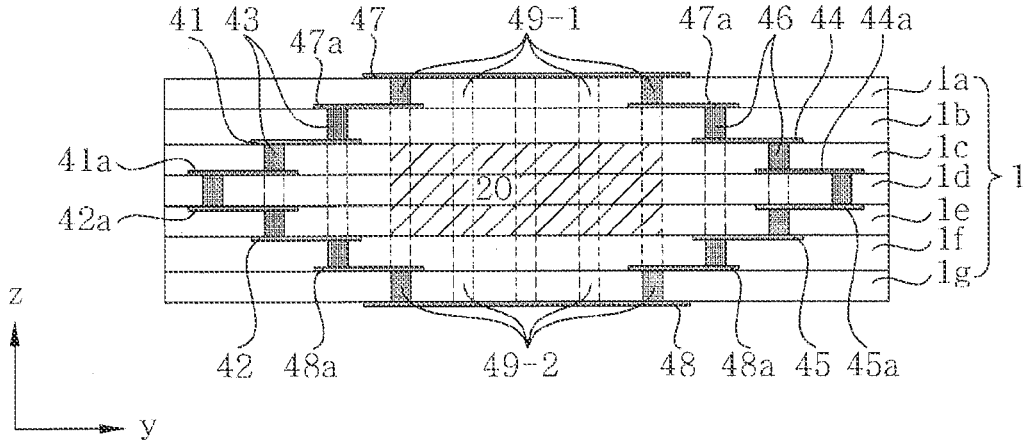
FIG. 1D is another cross-sectional view taken along the line B-B' in order to describe a step-shaped matching unit in the dielectric waveguide antenna shown in FIG. 1A.

FIG. 1A is a perspective view of a dielectric waveguide antenna according to a first preferred embodiment of the present invention; FIG. 1B is a cross-sectional view taken along the line A-A' in the dielectric waveguide antenna shown in FIG. 1A; FIG. 1C is a cross-sectional view taken along the line B-B' in the dielectric waveguide antenna shown in FIG. 1A; FIG. 1D is another cross-sectional view taken. along the line B-B' in order to describe a step-shaped matching unit in the dielectric waveguide antenna shown in FIG. 1A.

Referring to FIGS. 1A to 1D, a dielectric waveguide antenna according to a first preferred embodiment of the present invention, which is formed in a first dielectric substrate 1 having a plurality of dielectric layers (for example, 1*a* to 1*g*) stacked therein, is configured to include a power feeder 10, a dielectric waveguide 20, a dielectric waveguide radiator 30, and a matching unit 40.

The power feeder 10 applies a signal to the dielectric waveguide antenna according to the present embodiment.

The signal applied through the power feeder 10 is transmitted through the dielectric waveguide 20, and the signal transmitted from the dielectric waveguide 20 is radiated through a first aperture formed in the dielectric waveguide radiator 30.

Here, the signal, radiated from the dielectric waveguide radiator 30 to the air through the first aperture may be reflected in the first aperture due to impedance mismatching between the dielectric waveguide antenna and air.

In order to match the impedances between the dielectric waveguide antenna and the air, it is necessary to match impedances between the power feeder 10 and the dielectric waveguide 20 and between the dielectric waveguide 20 and the dielectric waveguide radiator 30, which configure the dielectric waveguide antenna.

Here, in order to match the impedances between the power feeder 10 and the dielectric waveguide 20, an appropriate back-short length d is required.

The back-short length d indicates a length d from a matching surface of the dielectric waveguide 20 to a center of the power feeder 10 (see FIG. 1B).

In addition, in order to match the impedances between the dielectric waveguide 20 and the dielectric waveguide radiator 30, an appropriate short-termination length D is required.

The short-termination length D indicates a length D from a bottom surface of the dielectric waveguide 20 to a bottom surface of the dielectric waveguide radiator 30 (see FIG. B).

The back-short length d and the short-termination length D are controlled, thereby making it possible to match the impedances among the power feeder 10, the dielectric waveguide 20 and the dielectric waveguide radiator 30.

In order to match the impedances between the dielectric waveguide antenna and the air, the matching unit 40 having various shapes may be formed, in addition to a method of controlling the back-short length d and the short-termination length D.

Hereinafter, each of the components of the dielectric waveguide antenna according to a first preferred embodiment of the present invention will be described in detail, The power feeder 10 may be implemented as a coaxial line as shown in FIGS. 1A and 1B, and the coaxial line includes a central conductor 11 for applying a signal and an insulator 13 enclosing the central conductor 11.

Here, a conductor 11*a* (hereinafter, referred to as a 'conductor for a probe') of the central conductor 11 inserted into the dielectric waveguide 20 or the first dielectric substrate 1 may be replaced by a metallic via hole.

As described above, although a preferred embodiment of the present invention describes a case in which the power feeder 10 has been implemented as the coaxial line, the present invention is not limited thereto. The power feeder 10 may also be implemented as a transmission line having, for example, a stripline structure, a microstripline structure, a coplanar waveguide structure (CPW), and the like.

The dielectric waveguide 20 transmits the signal applied from the power feeder 10 to the dielectric waveguide radiator 30 described below, as shown in FIGS. 1A to 1C.

The dielectric waveguide 20 includes a first conductor plate 21 having a predetermined shape, a second conductor plate 23 formed to be spaced from the first conductor plate 21 and correspond thereto, a first dielectric substrate 1 formed between the first and second conductor plates 21 and 23, and a plurality of first metal via holes 25 having a first opening surface opened so as to connect the dielectric waveguide 20 to the dielectric waveguide radiator 30 in order to transmit the signal applied from the power feeder 10 and vertically penetrating through circumferences of the first and second conductor plates 21 and 23 to thereby form a metal interface on a side of the first dielectric substrate 1.

Therefore, all surfaces of the dielectric waveguide 20 except for the first opening surface have the metal interface formed by the first and second conductor plates 21 and 23 and the plurality of first metal via holes 25, such that the dielectric waveguide 20 has a dielectric waveguide shape Capable of transmitting the signal applied to the power feeder 10 to the dielectric waveguide radiator 30 described below.

Here, in the dielectric waveguide 20, the plurality of first metal via holes 25 are not formed at the first opening surface.

That is, the dielectric waveguide 20 may transmit the signal applied from the power feeder 10 to the dielectric waveguide radiator 30 through the first opening surface opened so as to connect the dielectric waveguide 20 to the dielectric waveguide radiator 30 described below.

The dielectric waveguide radiator 30 includes a third conductor plate 31 having a first aperture formed therein, a fourth conductor plate 33 formed to be spaced from the third conductor plate 31 and correspond thereto, the first dielectric substrate 1 formed between the third and fourth conductor plates 31 and 33, and a plurality of second metal via holes 35 having a first opening surface opened so as to connect the dielectric waveguide radiator 30 to the dielectric waveguide 20 in order to receive the signal transmitted from the dielectric waveguide 20 and vertically penetrating through circumferences of the third and fourth conductor plates 31 and 33 to thereby form a metal interface on the side of the first dielectric substrate 1, as shown in FIGS. 1A to 1C.

Here, in the dielectric waveguide radiator 30, the plurality of second metal via holes 35 are not formed at the first opening surface.

Therefore, all surfaces of the dielectric waveguide radiator 30 except for the first opening surface and the first aperture have the metal interface formed by the third and fourth conductor plates 31 and 33 and the plurality of second metal via holes 35, such that the dielectric waveguide radiator 30 has a dielectric waveguide radiator shape receiving the signal from the dielectric waveguide 20 and radiating the received signal to the air.

Meanwhile, although FIGS. 1A to 1C show a case in which the dielectric waveguide 20 is formed in dielectric layers 1*c* to 1*e* having a height different from that of dielectric layers having the dielectric waveguide radiator 30 formed therein, the present invention is limited thereto. The dielectric waveguide 20 and the dielectric waveguide radiator 30 may be formed in the same dielectric layer 1*a* to 1*g* having the same height.

That is, the first conductor plate 21 of the dielectric waveguide 20 and the third conductor plate 31 of the dielectric waveguide radiator 30 may be integrally formed. Likewise, the second conductor plate 23 of the dielectric waveguide 20 and the fourth conductor plate 33 of the dielectric waveguide radiator 30 may be integrally formed.

In addition, although FIGS. 1A to 1C show a case in which the first to fourth conductor plates 21, 23, 31, and 33 have a rectangular shape (in the ease of the third conductor plate, the first aperture is formed), the present invention is not limited thereto. The first to fourth conductor plates 21, 23, 31, and 33 may be formed to have any shape and size.

The matching unit 40 is formed to have a horizontal structure, a vertical structure, and a horizontal-vertical combination structure in a portion of the dielectric waveguide 20 between the power feeder 10 and the dielectric waveguide radiator 30, as shown in FIGS. 1A to 1C.

The matching unit 40 according to a first preferred embodiment of the present invention is formed so that a dielectric volume is increased or decreased according to a change in a width and a height of a portion of the dielectric waveguide 20 and according to the horizontal structure, the vertical structure, and the horizontal-vertical combination structure, thereby controlling parallel and serial reactances.

The parallel and serial reactances are controlled, such that impedances between the dielectric waveguide antenna and the air may be controlled.

More specifically, the matching unit 40 according to a first preferred embodiment of the present invention is formed so that the dielectric volume is increased or decreased right and left (horizontally) or upward and downward (vertically) based on the dielectric waveguide 20 according to the change in a width and a height of a portion of the dielectric waveguide 20.

Here, a structure in which the dielectric volume is changed right and left, that is, horizontally based on the dielectric waveguide 20 according to the change in a width of a portion of the dielectric waveguide 20 is called the horizontal structure. The dielectric volume is increased or decreased horizontally according to the change in a width of a portion of the dielectric waveguide 20, such that the serial reactance is controlled.

In addition, a structure in which the dielectric volume is changed upward and downward, that is, vertically based on the dielectric waveguide 20 according to the change in a height of a portion of the dielectric waveguide 20 is called the vertical structure. The dielectric volume is increased and decreased vertically according to the change in a height of a portion of the dielectric waveguide 20, such that the parallel reactance is controlled.

The matching unit 40 according to a first preferred embodiment of the present invention may have the above-mentioned horizontal and vertical structures each separately formed in a portion of the dielectric waveguide 20 or have the horizontal-vertical combination structure in which the horizontal structure and the vertical structure coexist, as shown in FIGS. 1A to 1C.

First, the horizontal structure of the matching unit 40 according to a first preferred embodiment of the present invention may be divided into a left horizontal structure and a right horizontal structure based on the dielectric waveguide 20, as shown in FIGS. 1A to 1C.

The matching unit 40 having the left horizontal structure includes a fifth conductor plate 41 formed in a left horizontal direction based on the dielectric waveguide 20 and having a predetermined size, a sixth conductor plate 42 formed to be spaced from the fifth conductor plate 41 and correspond thereto, the first dielectric substrate 1 formed between the fifth and sixth conductor plates 41 and 42, and a plurality of third metal via holes 43 having a second opening surface connected to the dielectric waveguide 20 to thereby be opened and vertically penetrating through circumferences of the fifth and sixth conductor plates 41 and 42 to thereby form a metal interface on the side of the first dielectric substrate 1.

The matching unit 40 having the right horizontal structure includes a seventh conductor plate 44 formed in a right horizontal direction based on the dielectric waveguide 20 and having a predetermined size, an eighth conductor plate 45 formed to be spaced from the seventh conductor plate 44 and correspond thereto, the first dielectric substrate 1 formed between the seventh and eighth conductor plates 44 and 45, and a plurality of fourth metal via holes 46 having a third opening surface connected to the dielectric waveguide 20 to thereby be opened and vertically penetrating through circumferences of the seventh and eighth conductor plates 44 and 45 to thereby form a metal interface on the side of the first dielectric substrate 1.

Here, in the dielectric waveguide 20 connected to the matching unit 40 having the left and right horizontal structures, the plurality of first metal via holes 25 are not formed at the second and third opening surfaces.

That is, since the second and third opening surfaces at which the matching unit 40 having the horizontal structure is connected to the dielectric waveguide 20 are opened, the dielectric volume is increased or decreased horizontally by a size of the matching unit 40 having the horizontal structure according to the change in a dielectric width of a portion of dielectric waveguide 20, such that the parallel reactance may be controlled.

Meanwhile, the vertical structure of the matching unit 40 according to a first preferred embodiment of the present invention may divided into an upward vertical structure and a downward vertical structure based on the dielectric waveguide 20, as shown in FIGS. 1A to 1C.

The matching unit 40 having the upward vertical structure includes a ninth conductor plate 47 formed in an upward vertical direction based on the dielectric waveguide 20 and having a predetermined size, the first dielectric substrate 1 formed between the first and ninth conductor plates 21 and 47, and a plurality of fifth metal via holes 49-1 having a fourth opening surface connected to the dielectric waveguide 20 to thereby be opened and vertically penetrating through a circumference of the ninth conductor plate 47 to thereby form a metal interface on the side of the first dielectric substrate 1.

Here, in the dielectric waveguide 20 connected to the matching unit 40 having the upward vertical structures, the first conductor plate 21 is not formed at the fourth opening surface.

The matching unit 40 having the downward horizontal structure includes a tenth conductor plate 48 formed in a downward vertical direction based on the dielectric waveguide 20 and having a predetermined size, the first dielectric substrate 1 formed between the second and tenth conductor plates 23 and 48, and a plurality of sixth metal via holes 49-2 having a fifth opening surface connected to the dielectric waveguide 20 to thereby he opened and vertically penetrating through a circumference of the tenth conductor plate 48 to thereby form a metal interface on the side of the first dielectric substrate 1.

Here, in the dielectric waveguide 20 connected to the matching unit 40 having the downward vertical structures, the second conductor plate 23 is not formed at the fifth opening surface.

That is, since the surfaces at which the matching unit 40 having the vertical structure is connected to the dielectric waveguide 20 are opened, the dielectric volume is increased or decreased vertically by a size of the matching unit 40 having the vertical structure according to the change in a dielectric height of a portion of dielectric waveguide 20, such that the serial reactance may he controlled.

Although FIGS. 1A to 1C show a structure in which the matching unit 40 having the horizontal and vertical structure is formed to protrude horizontally or vertically to the outside of the dielectric waveguide 20, such that the dielectric volume is increased horizontally or vertically according to the change in the dielectric width and height of a portion of the dielectric waveguide 20, the present invention is not limited thereto. The matching unit 40 having the horizontal and vertical structure May also be formed to be depressed horizontally or vertically to the inside of the dielectric waveguide 20, such that the dielectric volume may be decreased horizontally or vertically according to the change in the dielectric width and height of a portion of the dielectric waveguide 20.

In addition, although FIGS. 1A to 1C show a case in which the matching unit 40 having the horizontal and vertical structure is formed to have a symmetrical shape in each of the horizontal and vertical directions based on the dielectric waveguide 20, the present invention is not limited thereto. The matching unit 40 having one direction structure, for example, any one of the left horizontal structure, the right horizontal structure, the upward vertical structure, and the downward vertical structure may be formed based on the dielectric waveguide 20 or be formed to have an asymmetrical shape in each of the horizontal and vertical directions based on the dielectric waveguide 20, as needed.

In addition, although FIGS. 1A to 1C show a case in which the fifth to tenth conductor plates 41, 42, 44, 45, 47, and 48 forming the matching unit 40 has a rectangular shape, the present invention is not limited thereto. The fifth to tenth conductor plates 41, 42, 44, 45, 47, and 48 may be formed to have any shape and size.

Further, although FIGS. 1A to 1C show a case in which the matching unit 40 having the horizontal and vertical structure defined by the fifth to tenth conductor plates 41, 42, 44, 45, 47, and 48 has a hexahedral shape, the present invention is not limited thereto. The matching unit 40 having the horizontal and vertical structure may have various shapes (for example, a polyprism shape).

Furthermore, the matching unit 40 having the horizontal and vertical structure defined by the fifth to tenth conductor plates 41, 42, 44, 45, 47, and 48 may also have a step shape in which it is increased or decreased stepwise in the horizontal and vertical directions, as shown in FIG. 1D.

As shown in FIG. 1D, when the matching unit 40 having the horizontal and vertical structure defined by the fifth to tenth conductor plates 41, 42, 44, 45, 47, and 48 has the step shape, it further includes a plurality of intermediate conductor plates 41*a*, 42*a*, 44*a*, 45*a*, 47*a* and 48*a* each formed between the fifth and sixth conductor plates 41 and 42, between the seventh and eighth conductor plate, 44 and 45, and between the ninth and tenth conductor plates 47 and 48.

The plurality of intermediate conductor plates 41*a*, 42*a*, 44*a*, 45*a*, 47*a* and 48*a* may be appropriately inserted between each of the dielectric layers 1*a* to 1*g* of the first dielectric substrate 1 so that the matching unit 40 according to a first preferred embodiment of the present invention is formed to have the step shape.

Figure 2A:
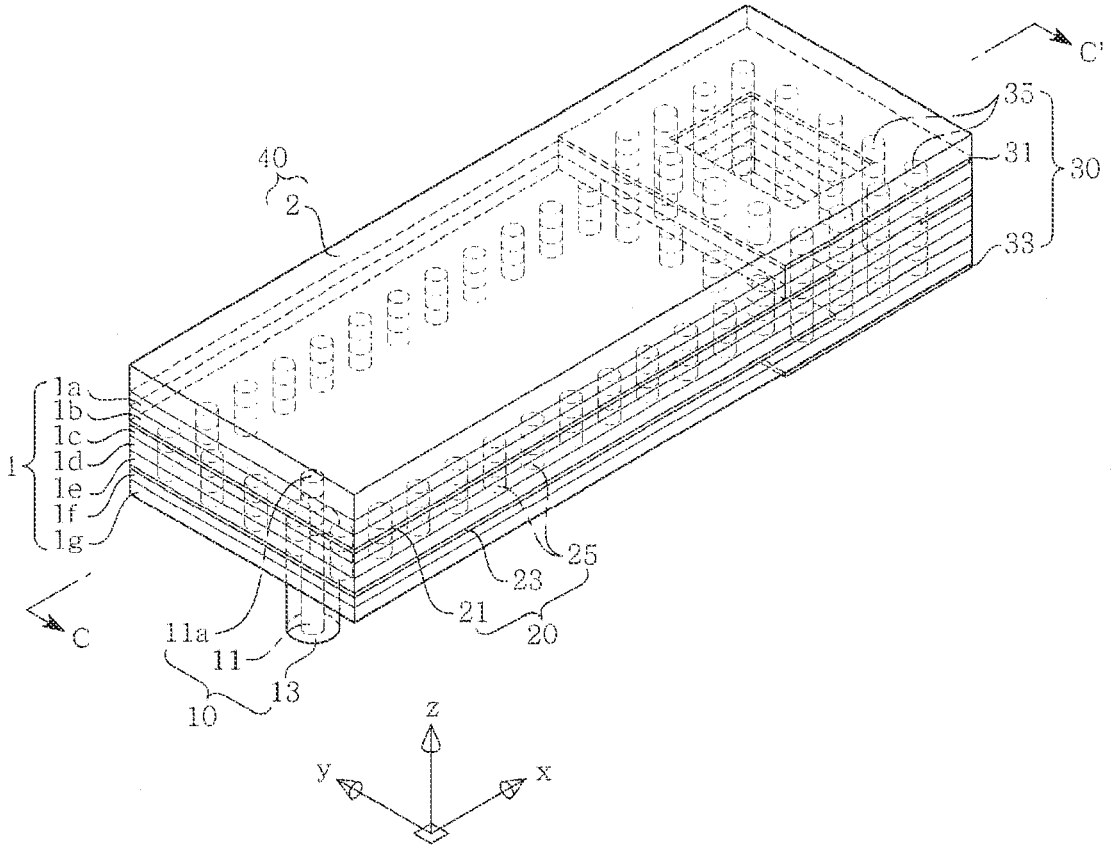
FIG. 2A is a perspective view of a dielectric waveguide antenna according to a second preferred embodiment of the present invention.
Figure 2B:
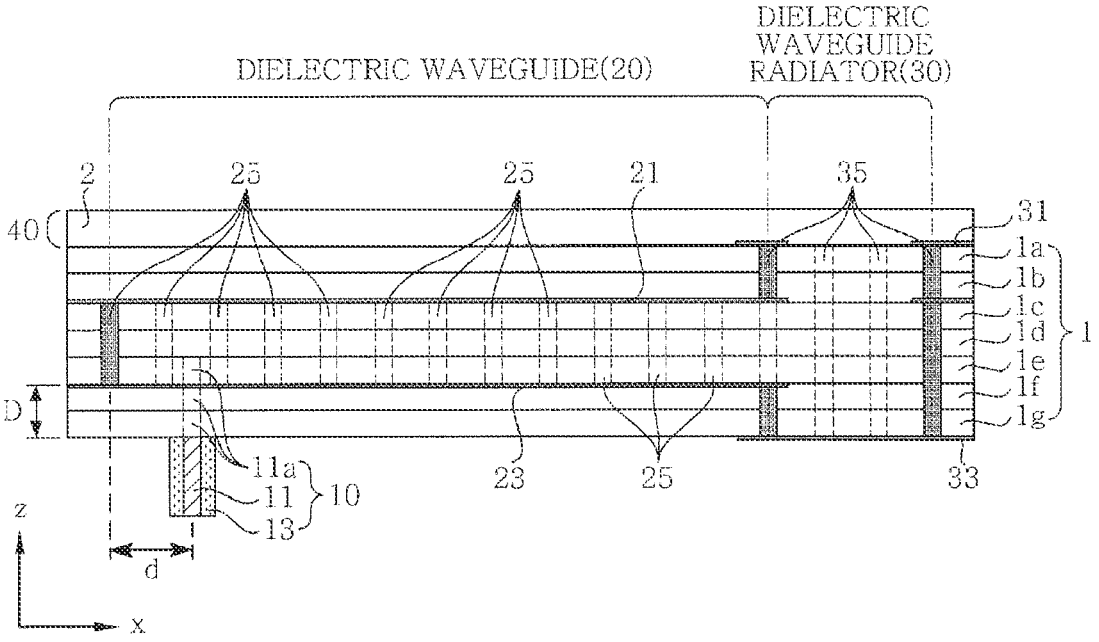
FIG. 2B is a cross-sectional view taken along the line C-C' in the dielectric waveguide antenna shown in FIG. 2A.
Figure 3A:
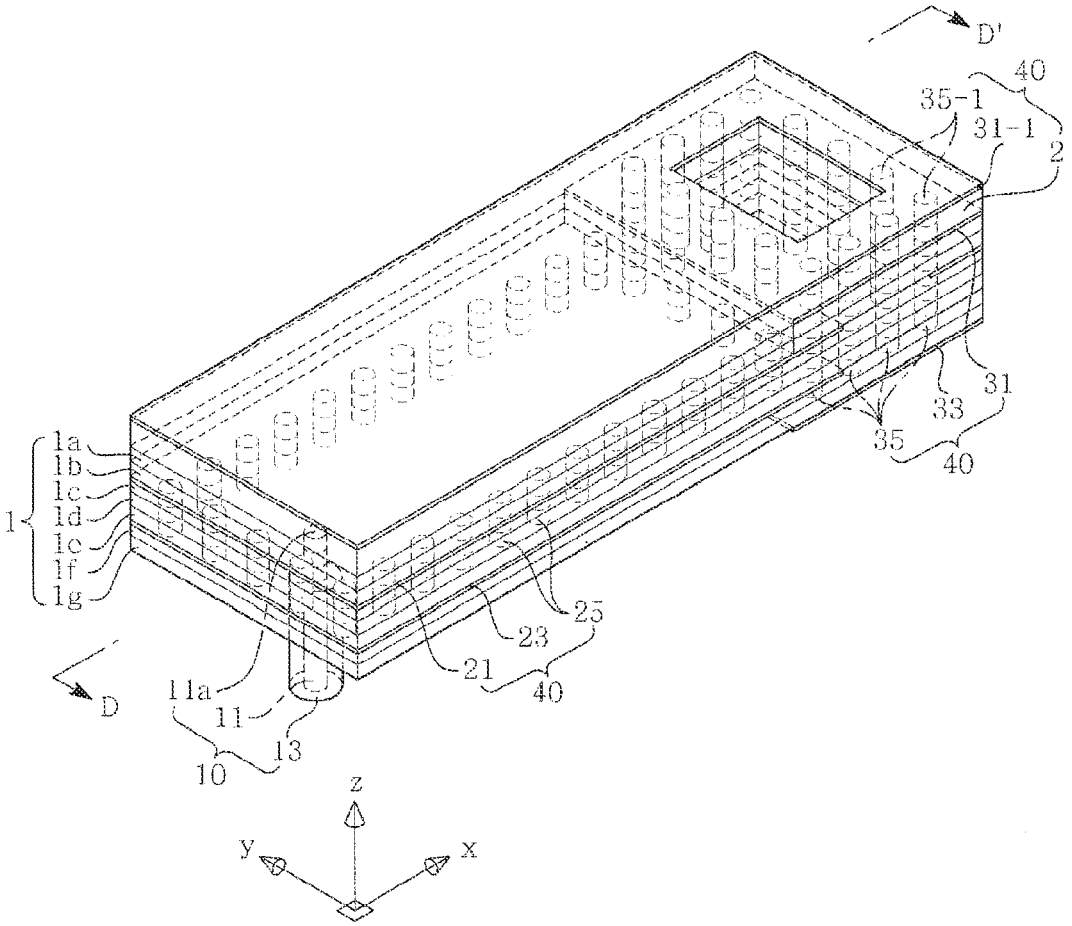
FIG. 3A is a perspective view of another dielectric waveguide antenna according to a second preferred embodiment of the present invention.
Figure 3B:
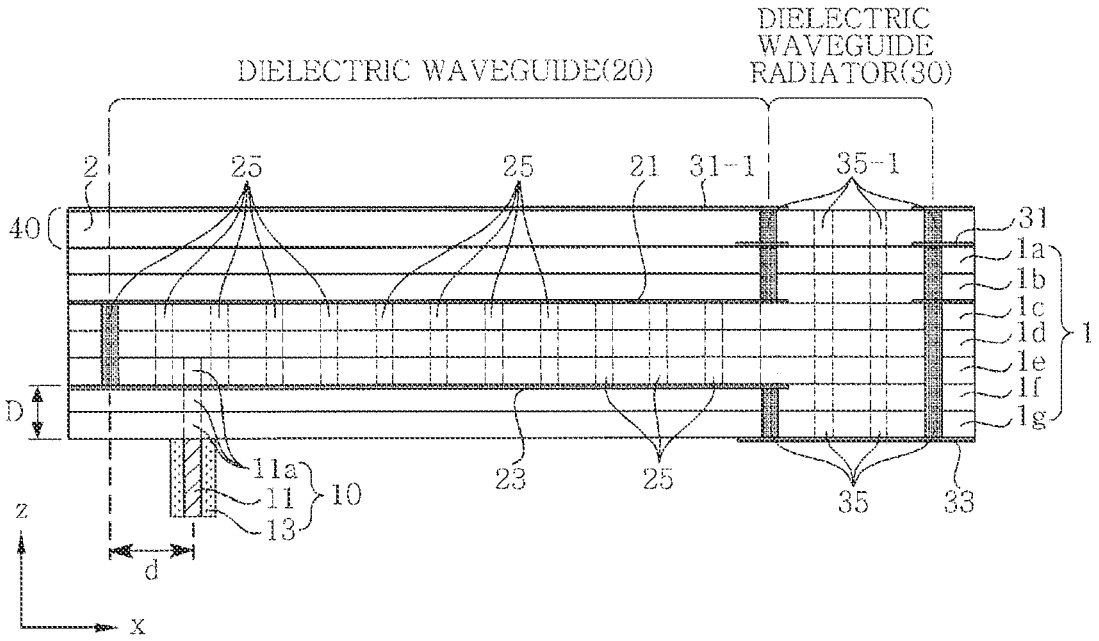
FIG. 3B is a cross-sectional view taken along the line D-D' in the dielectric waveguide antenna shown in FIG. 3A.

FIG. 2A is a perspective view of a dielectric waveguide antenna according to a second preferred embodiment of the present invention; FIG. 2B is a cross-sectional view taken along the line C-C' in the dielectric waveguide antenna shown in FIG. 2A; FIG. 3A. is a perspective view of another dielectric waveguide antenna according to a second preferred embodiment of the present invention; and FIG. 3B is a cross-sectional view taken along the line D-D' in the dielectric waveguide antenna shown in FIG. 3A.

Referring to FIGS. 2A and 2B, a dielectric waveguide antenna according to a second preferred embodiment of the present invention is the same as the dielectric waveguide antenna according to the first preferred embodiment of the present invention. except for a structure of the matching unit 40. Therefore, a detailed description for the same components will be omitted.

The matching unit 40 according to a second preferred. embodiment of the present invention includes a second dielectric substrate 2 stacked. on the aperture of the dielectric waveguide radiator 30, unlike the matching unit 40 according to the first preferred embodiment of the present invention formed in a portion of the dielectric waveguide 20 between the power feeder 10 and the dielectric waveguide radiator 30.

The matching unit 40 according to a second preferred embodiment of the present invention matches the impedances between the dielectric waveguide antenna and the air by controlling a dielectric constant or a thickness of the second dielectric, substrate 2 itself.

Although FIGS. 2A and 2B show a case in which the second dielectric substrate 2 used in the matching unit 40 according to a second preferred embodiment of the present invention is formed of a single dielectric layer, the present invention is not limited thereto. A multi-layer dielectric substrate formed of a plurality of dielectric layers may also be used.

Here, in the second dielectric substrate 2 used in the matching unit 40 according to a second preferred embodiment of the present invention, dielectric constants and thicknesses of the plurality of dielectric layers may be the same or different.

When the second dielectric substrate 2 is formed of the plurality of dielectric layers and the dielectric constants of each dielectric layer are different, the second dielectric substrate 2 may be a dielectric substrate stacked so that each dielectric layer of the second dielectric substrate 2 has a gradually increasing or decreasing dielectric constant from the dielectric waveguide radiator 30 toward the air according to a dielectric constant of the first dielectric substrate 1 having the dielectric waveguide radiator 30 formed therein and a dielectric constant of the air.

Here, a kind of the second dielectric substrate 2 used in the matching unit 40 according to a second preferred embodiment of the present invention is the same as that of the first dielectric substrate 1.

Meanwhile, the matching unit 40 of another dielectric waveguide antenna according to a second preferred embodiment of the present invention may be formed so that the aperture of the dielectric waveguide radiator 30 is extended up to an uppermost end of the second dielectric substrate 2, as shown in FIGS. 3A and 3B.

More specifically, referring to FIGS. 3A and 313, another matching unit 40 according to a second preferred embodiment of the present invention includes an eleventh conductor plate 31-1 having a second aperture corresponding to the first aperture, the second dielectric substrate 2 formed between the eleventh conductor plate 31-1 and the dielectric waveguide radiator 30, and a plurality of seventh metal via holes 35-1 corresponding to the plurality of second metal via holes 35 and vertically penetrating through a circumference of the second aperture to thereby form a metal interface on a side of the second dielectric substrate 2.

Here, a kind of the second dielectric substrate 2 used in another matching unit 40 according to a second preferred embodiment of the present invention is different from that of the first dielectric substrate 1.

Although FIGS. 3A and 3B show a case in which the second dielectric substrate 2 is formed of a single dielectric layer, the present invention is not limited thereto. A multi-layer dielectric substrate formed of a plurality of dielectric layers may also be used.

In addition, the first and second apertures in the dielectric waveguide antenna having the matching unit 40 shown in FIGS. 3A and 3B may have a size smaller than that of the first aperture in the dielectric waveguide antenna having the matching unit 40 shown in FIGS. 2A and 2B.

As described above, the dielectric waveguide antenna according to various preferred embodiments of the present invention matches the impedances between the dielectric waveguide antenna and the air through the matching unit having various shapes, thereby making it possible to reduce reflection generated in the aperture of the dielectric waveguide antenna.

As a result, the reflection generated in the aperture of the dielectric waveguide antenna is reduced, thereby making it possible to improve characteristics of the dielectric waveguide antenna.

With the dielectric waveguide antenna according to the preferred embodiment of the present invention, the matching unit having various structures is formed to match the impedances between the dielectric waveguide antenna. and the air, such that the reflection generated in the aperture of the dielectric waveguide antenna. is reduced, thereby making it possible to improve the antenna characteristics.

Embodiments of the present invention may suitably comprise, consist or consist essentially of the elements disclosed and may be practiced in the absence of an element not disclosed, For example, it can be recognized by those skilled in the art that certain steps can be combined into a single step.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A dielectric waveguide antenna, comprising:

a dielectric waveguide configured to transmit a signal applied from a power feeder;

a dielectric waveguide radiator configured to radiate the signal transmitted from the dielectric waveguide to the air through a first aperture; and a matching unit formed to be extended from a portion of the dielectric waveguide in one of a horizontal or vertical direction and configured to perform impedance matching on the first aperture, wherein the dielectric waveguide, the dielectric waveguide radiator, and the matching unit are formed in a first dielectric substrate.

2. The dielectric waveguide antenna as set forth in claim 1, wherein the dielectric waveguide comprises:

a first conductor plate;

a second conductor plate formed to be spaced from the first conductor plate and correspond thereto; and a plurality of first metal via holes formed to be spaced from each other at a predetermined interval on circumferences of the first conductor plate and the second conductor plate, wherein the plurality of first metal via holes are not formed on a first opening surface configured to transmit the signal to the dielectric waveguide radiator among one side of the dielectric waveguide.

3. The dielectric waveguide antenna as set forth in claim 2, wherein the dielectric waveguide radiator comprises:

a third conductor plate having a first aperture formed therein;

a fourth conductor plate formed to he spaced from the third conductor plate and correspond thereto; and a plurality of second metal via holes formed to be spaced from each other at a predetermined interval on circumferences of the third conductor plate and the fourth conductor plate.

4. The dielectric waveguide antenna as set forth in claim 2, wherein the matching unit comprises a left horizontal structure in which one side is formed to be extended toward a left direction based on the dielectric waveguide or a right horizontal structure in which the other side is formed to be extended toward a right direction based on the dielectric waveguide.

5. The dielectric waveguide antenna as set forth in claim 4, wherein the left horizontal structure comprises:

a fifth conductor plate formed to be extended from the first conductor plate;

a sixth conductor plate formed to be extended from the second conductor plate and correspond to the fifth conductor plate; and a plurality of third metal via holes formed to be spaced from each other at a predetermined interval on circumferences of the fifth conductor plate and the sixth conductor plate, wherein the plurality of third metal via holes are not formed on a second opening surface connecting to the dielectric waveguide among one side of the left horizontal structure.

6. The dielectric waveguide antenna as set forth in claim 4, wherein the right horizontal structure comprises:

a seventh conductor plate formed to be extended from the first conductor plate;

an eighth conductor plate formed to be extended from the second conductor plate and correspond to the seventh conductor plate; and a plurality of fourth metal via holes formed to be spaced from each other at a predetermined interval on circumferences of the seventh conductor plate and the eighth conductor plate, wherein the plurality of fourth metal via holes are not formed on a third opening surface connecting to the dielectric waveguide among one side of the right horizontal structure.

7. The dielectric waveguide antenna as set forth in claim 2, wherein the matching unit comprises an upward vertical structure in which an upper surface is formed to be extended in an upper direction based on the dielectric waveguide or a downward vertical structure in which a lower surface is formed to be extended in a lower direction based on the dielectric waveguide.

8. The dielectric waveguide antenna as set forth in claim 7, wherein the upward vertical structure comprises:

a ninth conductor plate formed to be spaced from the first conductor plate in an upward direction; and a plurality of fifth metal via holes formed to be spaced from each other at a predetermined interval on circumferences of the first conductor plate and the ninth conductor plate, wherein a fourth opening surface having an area thereof corresponding to the ninth conductor plate is formed on the first conductor plate.

9. The dielectric waveguide antenna as set forth in claim 7, wherein the downward vertical structure comprises:

a tenth conductor plate formed to be spaced from the second conductor plate in a downward direction; and a plurality of fifth metal via holes formed to be spaced from each other at a predetermined interval on circumferences of the second conductor plate and the tenth conductor plate, wherein a fifth opening surface having an area thereof corresponding to the tenth conductor plate is formed on the second conductor plate.

10. A dielectric waveguide antenna, comprising:

a dielectric waveguide configured to transmit a signal applied from a power feeder;

a dielectric waveguide radiator configured to radiate the signal transmitted from the dielectric waveguide to the air through a first aperture; and a second dielectric substrate formed on the first aperture for impedance matching therein, wherein the dielectric waveguide, the dielectric waveguide radiator, and the second dielectric substrate are formed in a first dielectric substrate.

11. The dielectric waveguide antenna as set forth in claim 10, wherein the second dielectric substrate comprises a dielectric having the same dielectric constant as the dielectric of the first dielectric substrate and a thickness thereof is determined within a range where the impedance of the first aperture is matched.

12. The dielectric waveguide antenna as set forth in claim 10, wherein the second dielectric substrate comprises at least one dielectric having a different dielectric constant from the dielectric of the first dielectric substrate.

13. The dielectric waveguide antenna as set forth in claim 12, wherein the second dielectric substrate comprises a plurality of dielectrics stacked thereon and having a different dielectric constant from each other, and the plurality of dielectrics is stacked toward a direction where the dielectric constant is one of increasing or decreasing.

* * * * *